US006118362A

United States Patent [19]

Tinkler et al.

[11] Patent Number: 6,118,362

[45] **Date of Patent: *Sep. 12, 2000**

[54] INTEGRATED INDUCTIVE ASSEMBLY

[75] Inventors: Ian Tinkler, Rockford; Terry J. Milroy, Loves Park; Graham T. Fordyce, Rockford, all of Ill.

[73] Assignee: Sundstrand Corporation, Rockford, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/788,926

[22] Filed: Jan. 24, 1997

[51] Int. Cl.[7] ..... H01F 27/06; H01F 27/28

[52] U.S. Cl. ..... 336/170; 336/65; 336/67

[58] Field of Search ..... 336/5, 65, 67, 336/170, 177, 180, 184, 221, 147, 148, 174, 175

[56] References Cited

U.S. PATENT DOCUMENTS

| | | | |
|---|---|---|---|
| 3,346,828 | 10/1967 | Buschman | 336/197 |
| 4,685,041 | 8/1987 | Bowman et al. | 363/40 |
| 4,700,166 | 10/1987 | Bradt | 336/175 |
| 5,015,984 | 5/1991 | Vialaneix | 336/197 |
| 5,032,814 | 7/1991 | Badaud | 336/65 |
| 5,184,291 | 2/1993 | Crowe et al. . | |
| 5,365,403 | 11/1994 | Vinciarelli et al. | 361/707 |
| 5,383,266 | 1/1995 | Soter | 336/210 |

FOREIGN PATENT DOCUMENTS

| | | | |
|---|---|---|---|
| 27 53 952 | 10/1978 | Germany | 336/197 |
| 60-37707 | 2/1985 | Japan | 336/5 |

OTHER PUBLICATIONS

Choi et al., "Polyphase Transformer Arrangements With Reduced kVA Capacities For Harmonic Current Reduction in Rectifier Type Utility Interface," IEEE 1995, (No Month) pp. 353–359.

*Primary Examiner*—Lincoln Donovan
*Assistant Examiner*—Anh Mai
*Attorney, Agent, or Firm*—Marshall, O'Toole, Gerstein, Murray & Borun

[57] ABSTRACT

An integrated inductive assembly includes first and second inductive elements each comprising a winding wherein winding axes of the windings are perpendicular to one another. In addition, the first and second inductive elements are carried adjacent one another by a bracket.

20 Claims, 7 Drawing Sheets

INTEGRATED INDUCTIVE ASSEMBLY

TECHNICAL FIELD

The present invention relates generally to electrical component assemblies, and more particularly to an integrated assembly of inductive components.

BACKGROUND ART

In many applications, such as in the aircraft or aerospace industry, there is a need to generate electrical power for components. Because synchronous generators are typically used in these applications and are driven by variable speed prime movers (such as an aircraft jet engine) variable or wild frequency power is readily available. Typically, electrical power frequency spans a 2 to 1 range owing to the speed range of the prime mover. Because variable frequency power causes difficulties for certain types of loads, it is common to rectify the variable frequency power to obtain DC power. This power is thereafter filtered and used directly for DC loads or is inverted to AC power at a fixed frequency for constant frequency AC loads. Rectification, however, results in the generation of harmonic currents. In many applications, the magnitudes of these harmonic currents must be limited in order to prevent disturbance to other loads on the system. A filter of some type is usually necessary to reduce the harmonic content to a sufficient degree.

The design of the filter is complicated owing to the variability of harmonic content with generator frequency. Because of the need to design the filter to handle a wide range of harmonic frequencies, a size, weight and performance penalty is incurred.

One solution to the foregoing problem is to double the number of supply phases for rectification. This has been accomplished in the past by utilizing a twelve-pulse converter which converts a three-phase output of the generator to six-phase power. The converter includes an isolation transformer having wye and delta connected secondary windings which are coupled to a DC bus by rectifier circuits and an interphase reactor. Such an approach raises the frequencies of the harmonics in the rectified DC power and reduces the amplitudes of the lowest order harmonics making them easier to filter. However, a system including such a transformer is undesirable owing to the size and weight thereof.

A paper entitled "Polyphase Transformer Arrangements With Reduced KVA Capacities For Harmonic Current Reduction In Rectifier Type Utility Interface" by Choi et al., IEEE Paper dated June, 1995, pages 353–359, discloses a twelve-pulse power supply system utilizing an autotransformer in place of the transformer having wye and delta connected secondaries. The autotransformer includes secondaries that are coupled through rectifier circuits to first and second interphase transformers which produce the DC power. The autotransformer parts can have reduced ratings, resulting in a component which is physically smaller, less costly and more efficient than the conventional transformer described above.

SUMMARY OF THE INVENTION

An integrated inductive assembly according to the present invention achieves a substantial reduction in size and weight as compared with conventional assemblies.

More particularly, an integrated inductive assembly includes a bracket member and first and second inductive elements each having a winding, a core portion extending through the winding and means extending about the core portions of the first and second inductive elements and about the bracket member for securing the inductive elements to the bracket member.

Preferably, an additional bracket member is held in position relative to the first named bracket member by the securing means. In addition, the securing means preferably comprise straps extending about upstanding portions of the bracket member.

Also in accordance with the preferred embodiment, the first inductive element comprises a polyphase autotransformer including a plurality of phase windings having parallel winding axes. In addition, the second inductive element may comprise an interphase transformer.

Still further in accordance with the preferred embodiment, the polyphase autotransformer includes a core portion in each phase winding.

A third inductive element may be disposed adjacent the second inductive element wherein the third inductive element includes a third winding having a third winding axis perpendicular to the second winding axis and wherein a third core portion extends into the third winding and is carried by the bracket. Preferably, the third inductive element comprises a DC filter.

According to another aspect of the present invention, an integrated inductive assembly includes a first inductive element comprising a first winding having a first winding axis extending in a first direction and a first core portion extending into the first winding and carried by a bracket. A second inductive element is carried by the bracket adjacent the first inductive element and includes a second winding having a second winding axis perpendicular to the first winding axis wherein a second core portion extends into the second winding.

In accordance with yet another aspect of the present invention, a method of assembling first and second inductive components to a bracket portion wherein each of the first and second inductive components includes a winding with a core portion therein includes the steps of placing the first and second inductive components adjacent the bracket portion and securing first and second straps extending about the core portions of the first and second inductive components around the bracket portion to secure the first and second components to the bracket portion.

The present invention permits a twelve-pulse power converter system to be packaged in a small volume, rendering the system particularly useful where space is at a premium, such as in aircraft and aerospace applications.

DESCRIPTION OF THE PREFERRED EMBODIMENTS

Figure 1:
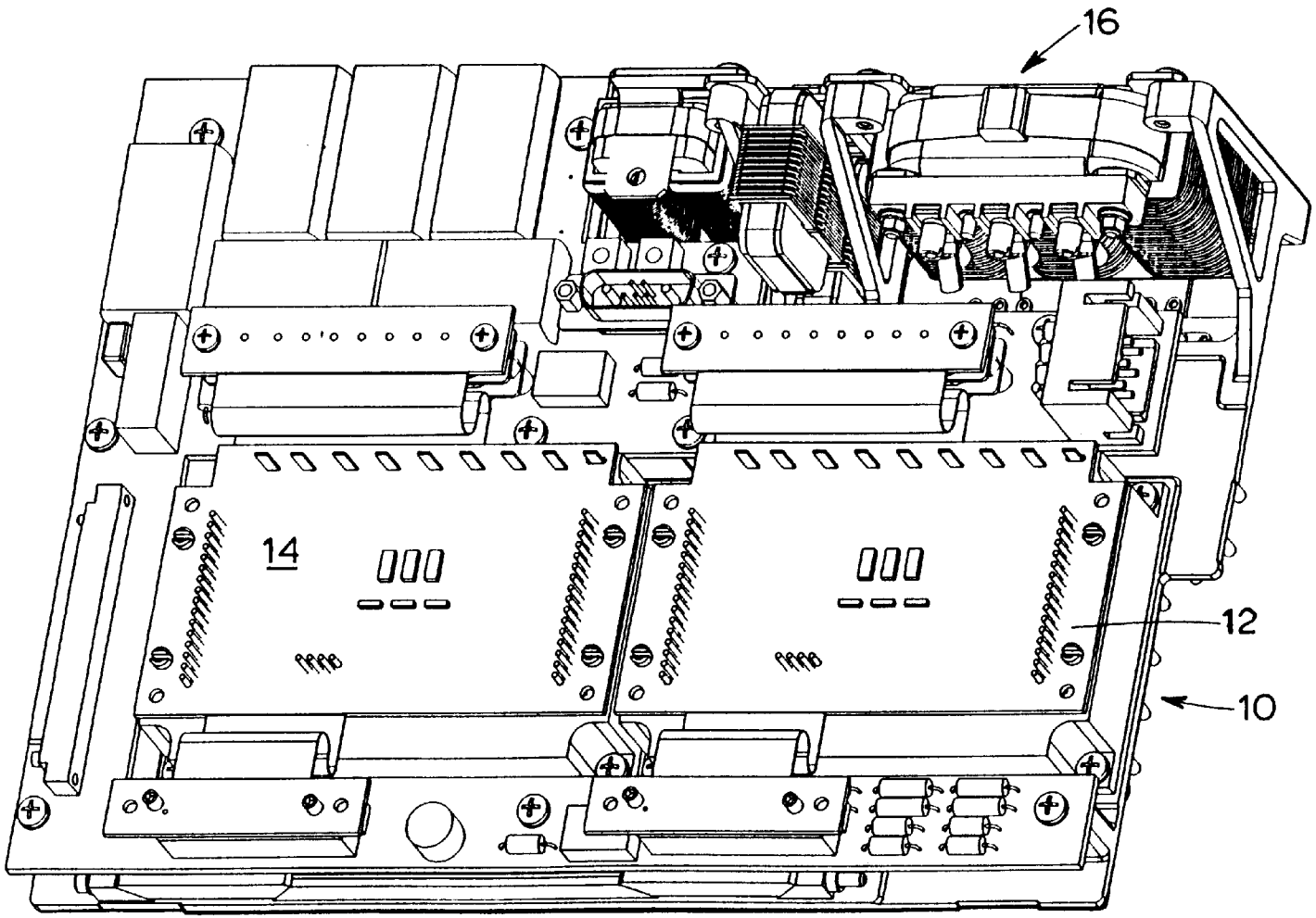
FIG. 1 is a trimetric view of a board assembly including the integrated inductive assembly of the present invention.

Referring now to FIG. 1, a board assembly 10 for controlling a motor driven component, such as a flap and a slat on an aircraft wing, includes power electronics in the form of first and second motor drives 12, 14 and an integrated inductive assembly 16 according to the present invention. The inductive assembly 16 and the remaining components of the board assembly 10 together provide power as needed to motors (not shown) which control the positioning of the flap and slat.

Figure 2:
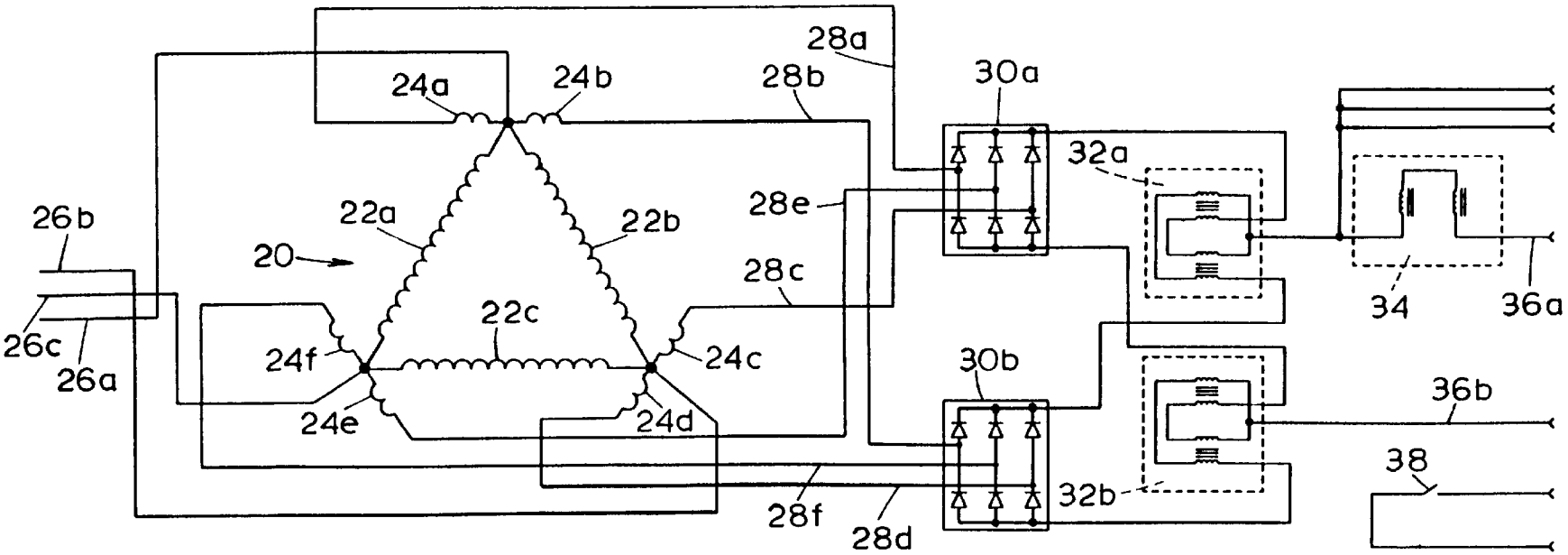
FIG. 2 is a schematic diagram of the electrical components forming the integrated inductive assembly of the present invention.

FIG. 2 illustrates the electrical components in the integrated inductive assembly 16. An autotransformer 20 includes first, second and third primary windings 22*a*–22*c* and first through sixth secondary windings 24*a*–24*f*, respectively. The transformer 20 converts three-phase power supplied to input conductors 26*a*–26*c* into six-phase power on lines 28*a*–28*f*. The power on the lines 28*a*, 28*c* and 28*e* is rectified by a first rectifier circuit or bridge 30*a* whereas the power on the lines 28*b*, 28*d* and 28*f* is rectified by a second rectifier circuit or bridge 30*b*. The outputs of the rectifier circuits 30*a*, 30*b* are combined by first and second interphase transformers (IPT's) 32*a*, 32*b* and the resulting power is filtered by a DC filter and inrush current choke 34 and (hereinafter referred to as the "DC filter") is supplied to other components over conductors 36*a*, 36*b*.

In addition to the foregoing components, a controller (not shown) detects the state of a thermal switch 38 which is provided as part of the integrated inductive assembly 16.

Figure 3:
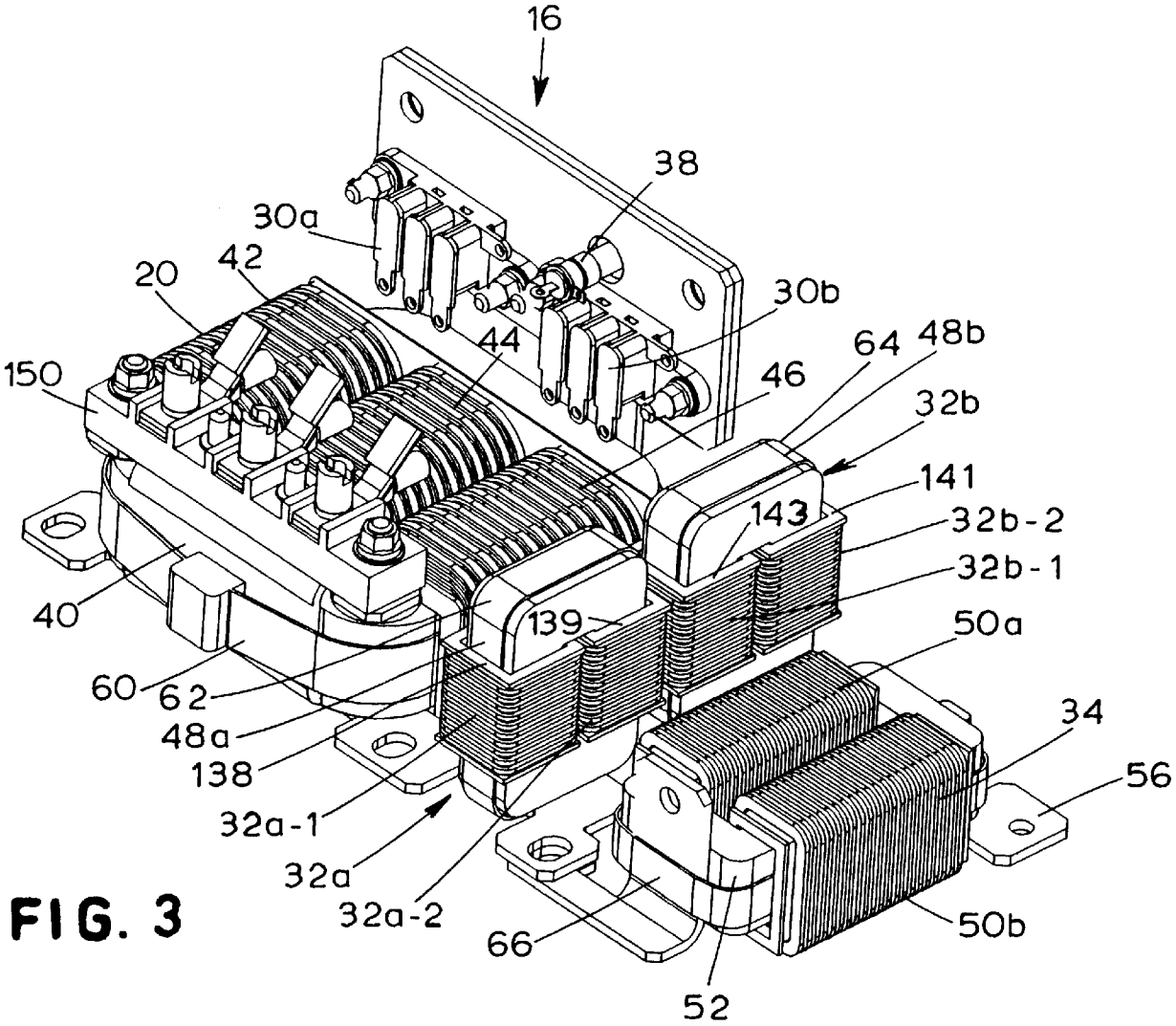
FIG. 3 is an isometric view of the integrated inductive assembly reoriented from the position shown in FIG. 1.
Figure 4:
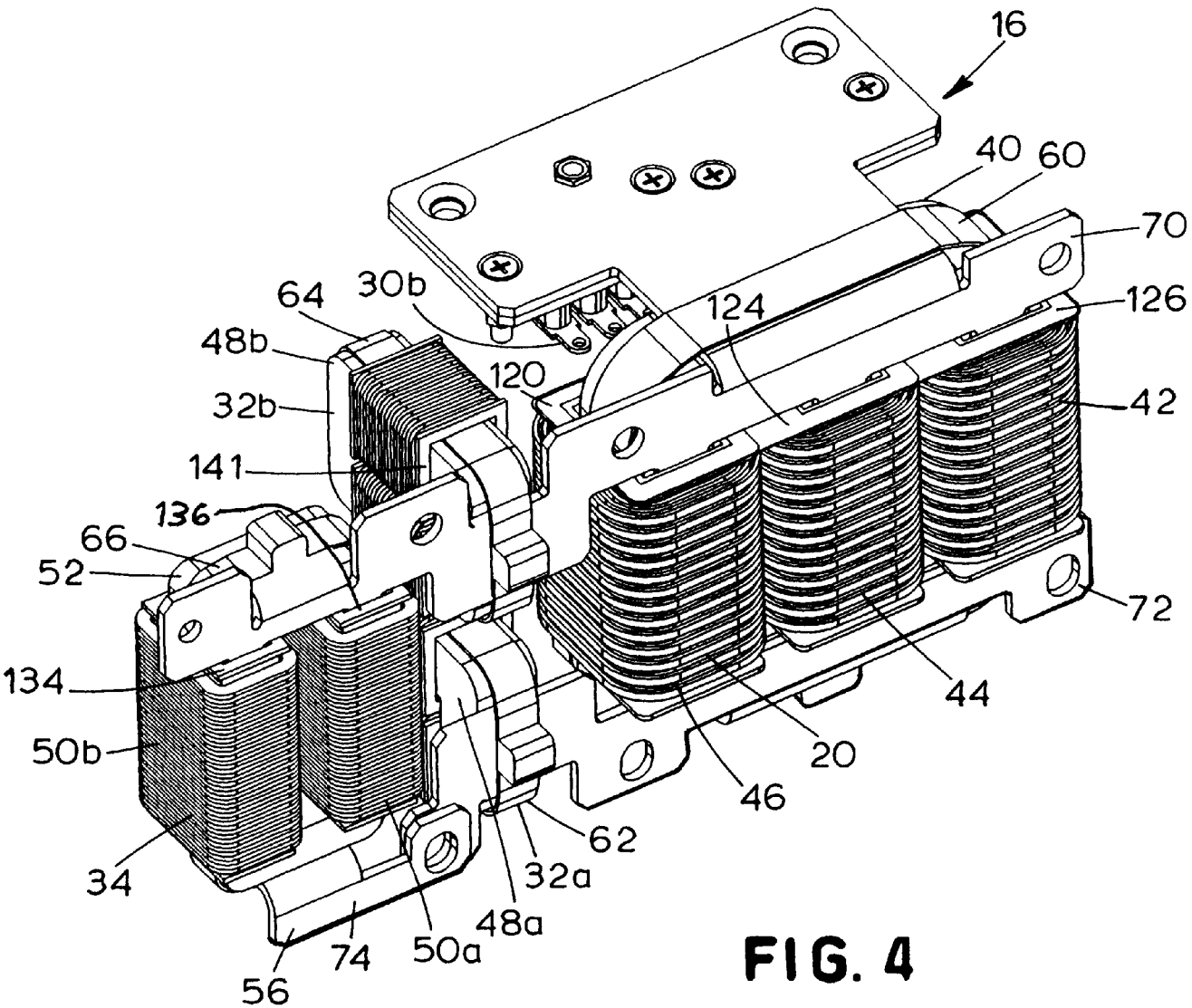
FIG. 4 is an isometric view of the integrated inductive assembly reoriented from the position of FIG. 3 to show opposite surfaces thereof.

FIGS. 3 and 4 illustrate the assembly 16 in greater detail. The transformer 20 includes a core assembly 40 including core portions that extend through winding assemblies 42, 44 and 46. Each winding assembly 42, 44 and 46 includes certain primary and secondary windings 22, 24 of the transformer 20 wound in coaxial relationship. The winding assemblies 42, 44 and 46 preferably have parallel winding axes.

The IPT's 32*a*, 32*b* include windings 32*a*-1, 32*a*-2 and 32*b*-1, 32*b*-2, respectively, preferably having parallel winding axes that are perpendicular to the winding axes of the winding assemblies 42, 44 and 46. The IPT's 32*a*, 32*b* further include cores 48*a*, 48*b*, respectively, including core portions that extend through the windings 32*a*-1, 32*a*-2 and 32*b*-1 and 32*b*-2, respectively.

The DC filter 34 includes windings 50*a*, 50*b* and a core 52 having core portions that extend therethrough. The windings 50*a*, 50*b* have winding axes that are preferably perpendicular to the winding axes of the windings 32*a*-1 and 32*a*-2.

Each of the cores 40, 48*a*, 48*b* and 52 is secured to a bracket 56 by straps 60, 62, 64 and 66, respectively.

Figure 5:
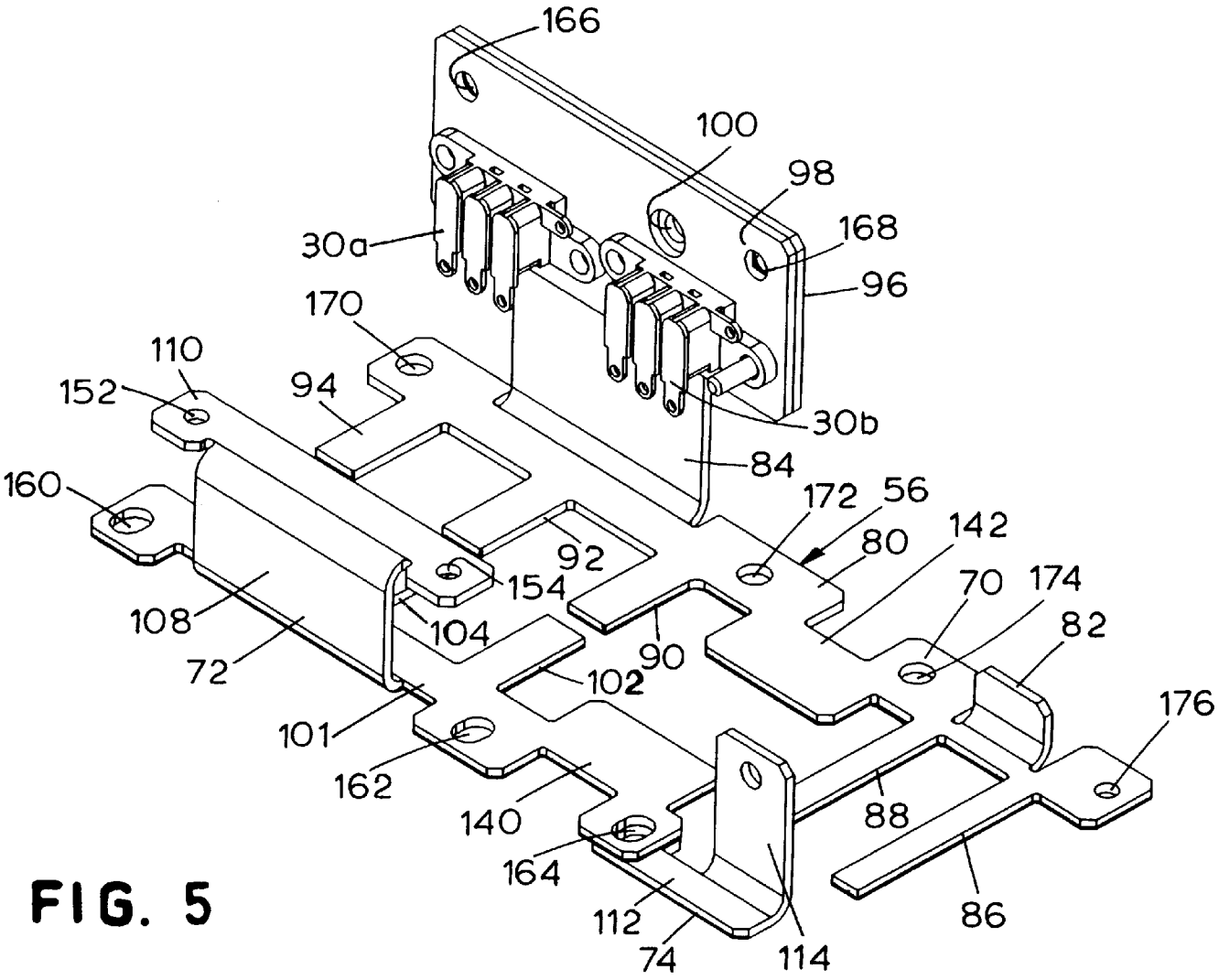
FIG. 5 is a view similar to the FIG. 3 with the windings and cores removed therefrom to illustrate the brackets.
Figure 6:
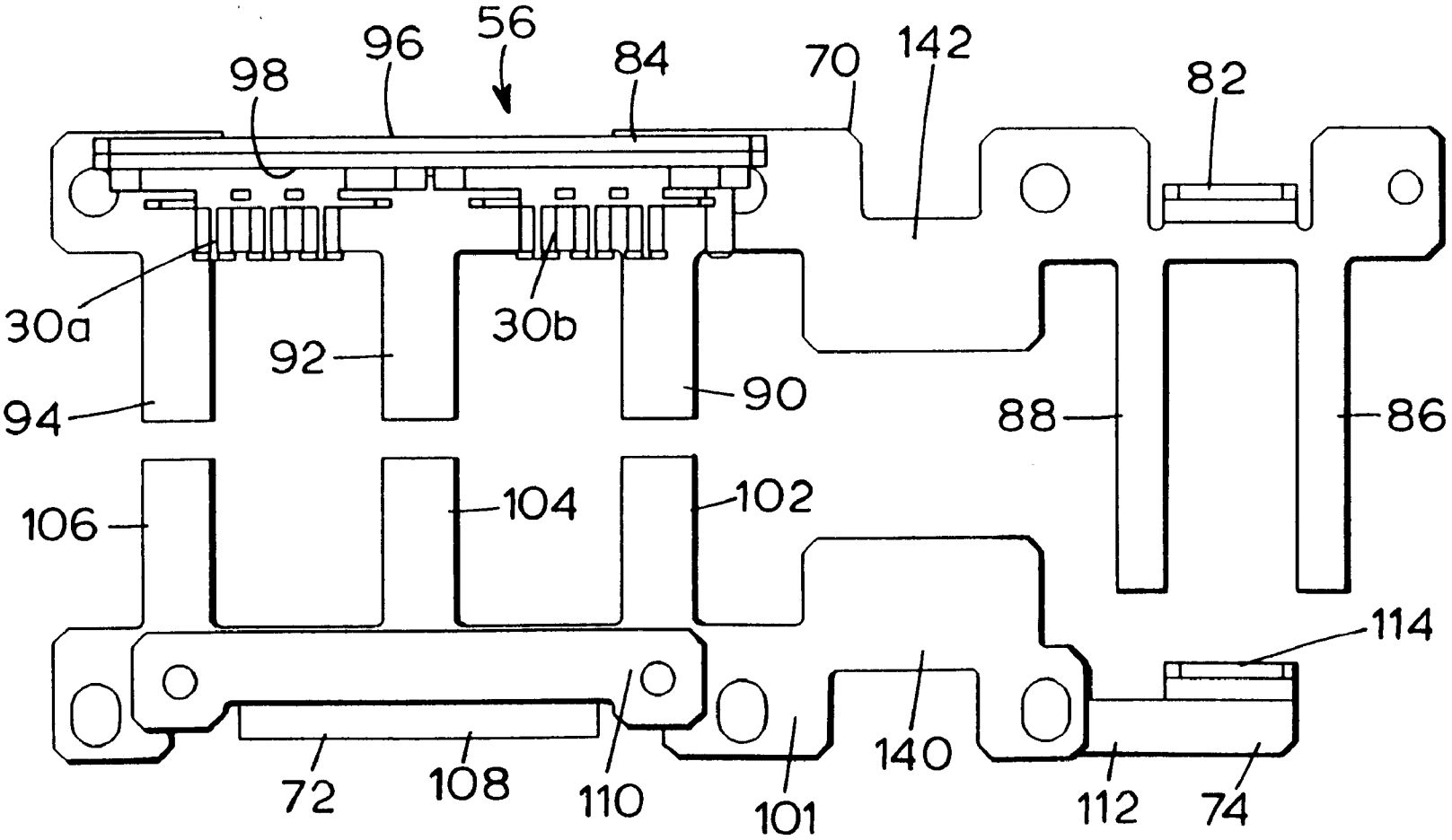
FIGS. 6 and 7 are elevational views of opposite sides of the brackets of FIG. 5.
Figure 7:
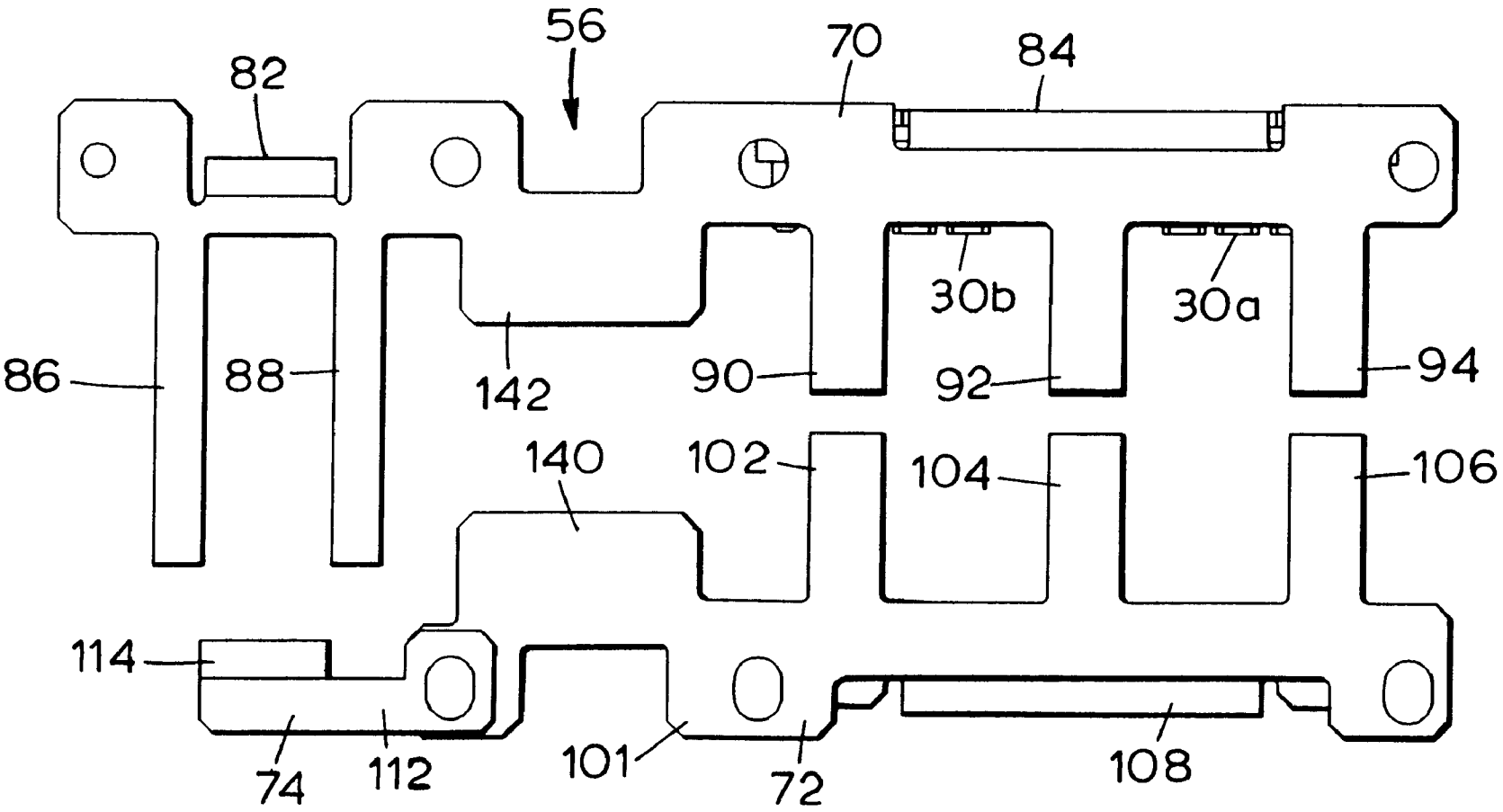

Referring now to FIGS. 5–7, the bracket 56 includes first, second and third bracket portions 70, 72 and 74. The bracket portion 70 includes a main planar body 80, first and second upstanding portions 82, 84 and first through fifth lateral extensions 86, 88, 90, 92 and 94, respectively. The upstanding portion 84 includes an enlarged mounting portion 96 to which a copper or other thermally conductive plate is secured by any suitable means. The rectifier bridges 30*a*, 30*b* are secured by fasteners to the plate 98. In addition, as seen in FIG. 3, the thermal switch 38 is secured by any suitable means in a bore 100 (seen in FIG. 5) in the enlarged mounting portion 96.

The bracket portion 72 includes a main planar body 101, lateral extensions, 102, 104, 106 and an upturned portion 108 having an inturned flange 110 (FIGS. 5 and 6).

The bracket portion 74 includes a main planar body 112 and an upstanding portion 114.

Preferably, although not necessarily, the bracket portions 70, 72 and 74 are fabricated of an electrically and thermally conductive material, such as aluminum, which may serve as a ground point for the electrical components of the assembly 16.

The assembly 16 is assembled by first placing the bracket member 70 in a fixture (not shown). The winding assemblies 42, 44 and 46 are wound on insulative coil bobbins 120, 124, 126 (FIG. 4) and the wound bobbins 120, 124, 126 together with the core 40 assembled therein are then inserted onto the lateral extensions 90, 92 and 94 of the bracket portion 70. In similar fashion, the winding assemblies 50*a* and 50*b* of the DC filter 34 are wound on insulative coil bobbins 134, 136 which receive the core 52 and the bobbins 134, 136 and core 52 are placed onto the lateral extensions 86, 88. The bracket portions 72 and 74 are then secured to the fixture such that the lateral extensions 102, 104 and 106 extend into the coil bobbins 120, 124, 126 and such that the bracket members 70, 72 and 74 assume the positions shown in FIGS. 5–7. The straps 60 and 66 are then secured in place around the upwardly extending members 84, 108 and 82, 114 to secure the components of the transformer 20 and the components of the DC filter 34 to the bracket 56. In addition, the windings 32*a*-1, 32*a*-2 and the core 48*a* are secured to a mounting portion 140 by the strap 62 whereas the windings 32*b*-1, 32*b*-2 and the core 48*b* are secured by the strap 64 to a mounting portion 142 of the bracket member 70. (The windings 32*a*-1 and 32*a*-2 are wound on insulative coil bobbins 138, 139 while the windings 32*b*-1 and 32*b*-2 are wound on insulative coil bobbins 143, 141, FIG. 3.) The straps 60, 62, 64 and 66 may be secured by any suitable means, such as by crimping a deformable member which engages ends of the straps, by crimping or otherwise deforming the strap material itself, by welding or any other fashion.

A terminal block 150 (FIG. 3) is secured by bolts extending through holes 152, 154 to the inturned flange 110. The windings of the assemblies 42, 44 and 46 are connected to the terminal block 150. The input conductors 26*a*, 26*b* and 26*c* (FIG. 2) are connected to the primary windings 22*a*, 22*b* and 22*c* at the terminal block 150. Direct connections (not shown) are made between the transformer 20 and the rectifier bridges 30*a*, 30*b* and from the rectifier bridges 30*a*, 30*b* to the IPT's 32*a*, 32*b* and the DC filter 34 without the use of terminal blocks or other bulky equipment. (These connections are not shown for sake of clarity.) Thus, size and weight are minimized.

Once the various components are assembled on the bracket portions 70, 72 and 74, the straps 60–66 hold the various components and bracket portions together to maintain the assembly 16 as an integral unit. The assembly 16 is then bolted to the board assembly 10 by screws or bolts extending through holes 160, 162, 164, 166, 168, 170, 172, 174 and 176 (FIG. 5).

The present invention permits a twelve-pulse converter to be designed which occupies a minimum of space. This is achieved in part by using the straps 60, 62, 64 and 66 to hold the assembly components together, rather than banding the cores and then attaching the cores to the components with other apparatus.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. An integrated inductive assembly, comprising:

a first bracket member having first and second fastening sections;

a first inductive element having a winding associated with a core, a portion of the core extending through the associated winding, the first inductive element being positioned adjacent the first fastening section of the first bracket member;

a second inductive element having a winding associated with a core, a portion of the core extending through the associated winding, the second inductive element being positioned adjacent the second fastening section of the first bracket member;

a first securing means extending about the core of the first inductive element and about the first fastening section of the first bracket member for securing the first inductive element to the first bracket member; and a second securing means extending about the core of the second inductive element and about the second fastening section of the first bracket member for securing the second inductive element to the first bracket member.

2. The integrated inductive assembly of claim 1, further including a second bracket member held in position relative to the first bracket member by the first and second securing means.

3. The integrated inductive assembly of claim 1, wherein the first and second fastening sections of the first bracket member are formed as first and second upstanding portions, and the first and second securing means comprise first and second straps extending about the first and second upstanding portions.

4. The integrated inductive assembly of claim 1, wherein the first inductive element comprises a polyphase autotransformer including a plurality of phase windings having parallel winding axes.

5. The integrated inductive assembly of claim 4, wherein the second inductive element comprises an interphase transformer.

6. The integrated inductive assembly of claim 5, wherein the polyphase autotransformer includes a core portion in each phase winding.

7. The integrated inductive assembly of claim 1, wherein the first bracket member has a third fastening section, and further including a third inductive element adjacent the second inductive element wherein the third inductive element includes a third winding having a third winding axis perpendicular to the second winding axis and wherein a third core portion extends through the third winding, the third inductive element being positioned adjacent the third fastening section, and a third securing means extends about the core of the third inductive element and about the third fastening section of the first bracket member for securing the third inductive element to the first bracket member.

8. The integrated inductive assembly of claim 7, wherein the third inductive element comprises a DC filter.

9. An integrated inductive assembly comprising:

a bracket having a first lateral extension and a fastening section;

a first inductive element comprising a first winding on a first bobbin, the first winding having a first winding axis extending in a first direction and a first core, a portion of the first core extending into the first winding, the first bobbin and first core being inserted onto the first lateral extension of the bracket; and a second inductive element comprising a second winding on a second bobbin, the second winding having a second winding axis perpendicular to the first winding axis and a second core, a portion of the second core extending into the second winding, the core being located adjacent the fastening section of the bracket, and securing means extending about the second core and about the fastening section for securing the second inductive element to the bracket adjacent the first inductive element.

10. The integrated inductive assembly of claim 9, wherein the first inductive element comprises a polyphase autotransformer including a plurality of phase windings having parallel winding axes.

11. The integrated inductive assembly of claim 10, wherein the polyphase transformer includes a core portion in each phase winding.

12. The integrated inductive assembly of claim 9, further including a third inductive element adjacent the second inductive element and carried by the bracket.

13. The integrated inductive assembly of claim 12, wherein the third inductive element includes a third winding on a third bobbin, the third winding having a third winding axis perpendicular to the second winding axis.

14. The integrated inductive assembly of claim 13, wherein the bracket has a second lateral extension and wherein a third core portion extends into the third winding, the third bobbin and third core being inserted onto the second lateral extension of the bracket.

15. The integrated inductive assembly of claim 14, wherein the bracket comprises separate bracket portions.

16. The integrated inductive assembly of claim 15, wherein the second inductive element comprises an interphase transformer.

17. The integrated inductive assembly of claim 16, wherein the third inductive element comprises a DC filter.

18. A method of assembling first and second inductive components to first and second fastening sections of a first bracket portion, wherein the first and second inductive components include first and second windings associated with first and second cores, respectively, each core having a portion extending through an associated winding, the method comprising the steps of:

placing the first inductive component adjacent the first fastening section of the first bracket portion;

securing a first strap about the core portion of the first inductive component and around the first fastening section of the first bracket portion to secure the first inductive component to the first bracket portion;

placing the second inductive component adjacent the second fastening section of the first bracket portion; and securing a second strap about the core portion of the second inductive component and around the second fastening section of the first bracket portion to secure the second inductive component to the first bracket portion.

19. The method of claim 18, further including a second bracket portion and wherein the step of securing comprises the step of wrapping the straps around the second bracket portion to secure the bracket portions together.

20. The method of claim 19, wherein the first and second inductive components comprise an autotransformer and an interphase transformer, respectively, and further including the steps of providing a third bracket portion and securing a DC filter element to the first and third bracket portions using a strap extending about a core portion of the DC filter element.

* * * * *